US006530254B2

(12) United States Patent
Beierling

(10) Patent No.: US 6,530,254 B2
(45) Date of Patent: Mar. 11, 2003

(54) ROLLING MACHINE

(75) Inventor: Hans-Jürgen Beierling, Paderborn (DE)

(73) Assignee: Mauser-Werke GmbH & Co. KG, Brühl (DE)

( * ) Notice: Subject to any disclaimer, the term of this patent is extended or adjusted under 35 U.S.C. 154(b) by 0 days.

(21) Appl. No.: 09/765,767

(22) Filed: Jan. 19, 2001

(65) Prior Publication Data

US 2002/0005054 A1 Jan. 17, 2002

(Under 37 CFR 1.47)

Related U.S. Application Data

(63) Continuation of application No. PCT/EP00/04656, filed on May 22, 2000.
(60) Provisional application No. 60/164,534, filed on Nov. 10, 1999.

(30) Foreign Application Priority Data

May 21, 1999 (DE) ..... 299 08 996 U.

(51) Int. Cl.[7] ..... B21D 1/08
(52) U.S. Cl. ..... 72/113; 72/96; 72/120; 72/208; 72/370.01
(58) Field of Search ..... 72/95, 96, 99, 72/100, 113, 120, 208, 209, 370.01, 370.04; 228/125, 158

(56) References Cited

U.S. PATENT DOCUMENTS

| | | | | |
|---|---|---|---|---|
| 2,177,104 A | * | 10/1939 | Gonser | 72/113 |
| 2,644,416 A | | 7/1953 | Miller et al. | |
| 2,934,981 A | | 5/1960 | Pearson | |
| 3,025,816 A | | 3/1962 | McCoy | |
| 3,223,063 A | | 12/1965 | Payton | |
| 6,216,511 B1 | * | 4/2001 | Ohnishi et al. | 72/113 |

FOREIGN PATENT DOCUMENTS

| | | | | |
|---|---|---|---|---|
| DE | 633 683 C | | 8/1936 | |
| DE | 749 683 | | 12/1944 | |
| DE | 196 37 107 A | | 7/1997 | |
| EP | 0 164 161 A | | 12/1985 | |
| GB | 484 140 A | | 5/1938 | |
| JP | 57-106428 | * | 7/1982 | 72/113 |
| JP | 60 003995 A | | 1/1985 | |
| JP | 5-96336 | | 4/1993 | |

OTHER PUBLICATIONS

Automation, vol. 7, No. 6, Jun. 1960, p. 63–66, XP002031423: "Fabricating Steel Drum Shells", see p. 66; figure 7.
DE–Z.: Blech Rohre Profile Mar. 1972, Neue Fertigungseinheit zum Herstellen von Fässern, p. 111–114.
Das Industrieblatt, Stuttgart, Mar. 1955, p. 99.

* cited by examiner

*Primary Examiner*—Ed Tolan
(74) *Attorney, Agent, or Firm*—Henry M. Feiereisen; Ursula B. Day

(57) ABSTRACT

A rolling machine for processing a metal container which has a longitudinal seam and is made from a flat metal plate to form a cylindrical body having adjacent or overlapping butt edges securely joined to one another by folding or welding, whereupon a disk-shaped lower bottom and, optionally, a respective upper bottom, is welded or folded to the cylindrical body to form a closed container, or an open-topped container, respectively, is configured as a continuous rolling machine and includes an upper carrier frame; an upper rolling drum rotatably supported in the upper carrier frame; a lower drum stand; and a driven lower rolling drum rotatably mounted in the lower drum stand.

23 Claims, 3 Drawing Sheets

ROLLING MACHINE

CROSS-REFERENCES TO RELATED APPLICATIONS

This application claims the priority of German Patent Application Serial No. 299 08 996. 7, filed May 21, 1999, the subject matter of which is incorporated herein by reference.

This application claims the benefit of prior filed provisional application, Appl. No. 60/164,534, filed Nov. 10, 1999, pursuant to 35 U.S.C. 119(e).

This application is a continuation of prior filed copending PCT International application no. PCT/EP00/04656, filed May 22, 2000 and claiming priority of German Patent Application Serial No. 299 08 996. 7, filed May 21, 1999 and U.S. provisional application, Appl. No. 60/164,534, filed Nov. 10, 1999.

BACKGROUND OF THE INVENTION

The present invention relates, in general, to a rolling machine for rolling a metal container with a longitudinal seam, in particular a sheet steel container.

Typically, a cylindrical body, as intermediate product, is bent from a flat metal plate, with adjacent or overlapping butt edges securely joined to one another by folding or welding. Subsequently, a disk-shaped lower bottom and, optionally, a respective upper bottom, is welded or folded to the cylindrical body to form a closed container or, optionally, an open-topped container. Conventional sheet steel containers suffer shortcomings because the inside welding seam edge is oftentimes a cause of premature rust formation and contamination of the contents.

In order to address this problem, German Pat. No. DE 196 37 107 A1 proposes a flattening and smoothing of the welding seam and the overlapping material area by employing a rolling machine so that application of a paint is possible and the formation of clusters of rust, in particular in the interior of the container along the welding seam, can substantially be eliminated. The rolling machine described in German Pat. No. DE 196 37 107 A1 includes a rolling drum, which is secured on the outside to a free cantilevered arm. This arm has to absorb great forces and thus is configured of substantial size to prevent flexure. In order to enable a continuous production, the cantilevered arm is rotatably supported whereby disadvantageously great masses need to be moved in short time intervals.

SUMMARY OF THE INVENTION

It is an object of the present invention to provide an improved rolling machine, obviating the afore-stated drawbacks.

In particular, it is an object of the present invention to provide an improved rolling machine for processing metal containers with longitudinal seams, which realizes high production speeds, without requiring a swinging or rotating of large machine components so as to eliminate a need to move masses.

These objects, and other which will become apparent hereinafter, are attained in accordance with the invention by configuring the rolling machine as linear continuous rolling machine which includes an upper carrier frame; an upper rolling drum rotatably supported in the upper carrier frame; a lower drum stand; and a driven lower rolling drum rotatably mounted in the lower drum stand. In accordance with the present invention, the upper carrier frame for acting on the inside surface of the body is supported in a so-called "floating" manner, i.e. connected to the lower drum stand in an alternating manner by first and second locking devices.

As the result of the rolling process over the entire body length or along the entire longitudinal welding seam or folding seam of the container, the adjacent or overlapping butt edges of the cylindrical body, i.e. envelope, are closed (filled) in the area of the longitudinal welding seam and the rebounding gusset zone inside as well as outside along the overlapping end edges through material displaced laterally in circumferential direction by the rolling process, and disappear. As a consequence, easy application of paint, in particular the interior painting, or of a powder coating is ensured even in this otherwise very critical zone. Through the provision over a smooth, continuous paint coat, the area of the welding seam or fold is no longer recognizable and the above-stated drawbacks are eliminated.

The transport or the forward motion of the sheet metal body (envelope) in the welding machine is typically realized by a corrugated feed roller which engages in the area of the overlap region. During passage of the body, the individual corrugations are pressed into the material to create an unsightly fluting. By smoothing the area of the longitudinal seam of the sheet metal body in accordance with the invention, also this fine fluting disappears.

In accordance with the present invention, the overlapping wall area of the cylindrical envelope is rolled flat along the longitudinal seam of a longitudinally welded container from about twice the strength to at least 1 ½ times of the strength or to the normal single strength of the metal plate or to the wall strength of the body. Thereby, the rolling process is suitably carried out in immediate succession of the welding procedure at still elevated temperature of the material of the longitudinal seam area to be rolled, thereby smoothing all uneven zones. In particular in conjunction with large-volume containers, such as e.g. a 220 liter steel drum with a drum wall height or welding seam length of approximately 900 mm, smoothing of the longitudinal seam results in a substantial improvement of the product quality.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
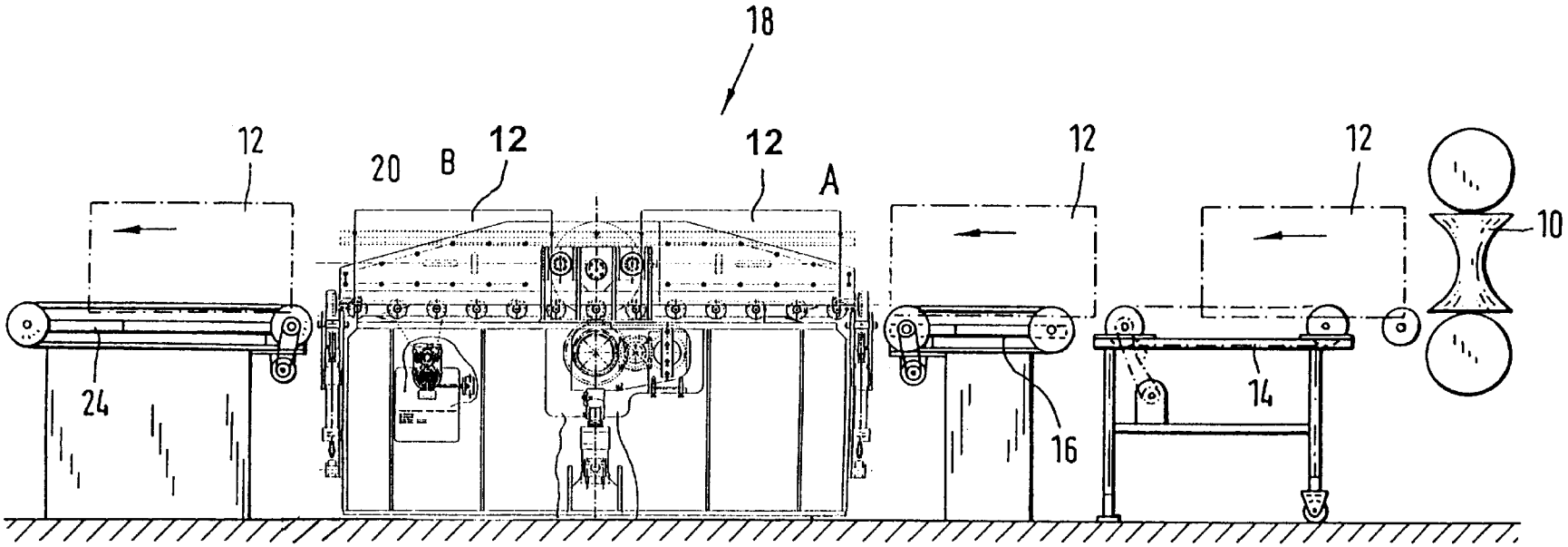
FIG. 1 is a schematic overall view of an arrangement for making bodies and rolling longitudinal seams of the bodies.

Throughout all the Figures, same or corresponding elements are generally indicated by same reference numerals.

Turning now to the drawing, and in particular to FIG. 1, there is shown a schematic overall view of an arrangement for fabricating and rolling bodies 12. The bodies 12 are made from a flat metal plate to form a cylindrical body having adjacent or overlapping butt edges which are securely joined to one another by an automatic welding machine 10 along a longitudinal seam. The thus welded body 12 is transferred from the welding machine 10 to a separate discharge conveyor 14 for transport in a direction indicated by the arrow to a separate transfer conveyor 16 from which the individual bodies 12 are transported to a rolling machine, generally designated by reference numeral 18, for rolling the adjacent or overlapping butt edges of the cylindrical body 12 over the entire length of the cylindrical body in the area of the longitudinal welding seam. The discharge conveyor 14 normally runs at a same conveyance speed as the automatic welding machine 10 whereas the bodies 12 can be temporarily stopped on the transfer conveyor 16 and accelerated again for loading the rolling machine 18. The conveyors 14, 16 are hereby equipped with respective drive motors. A disk-shaped lower bottom (not shown) and, optionally, a respective upper bottom (not shown), can be welded subsequently to the rolled body to form a closed container, or an open-topped container, respectively.

Figure 2:
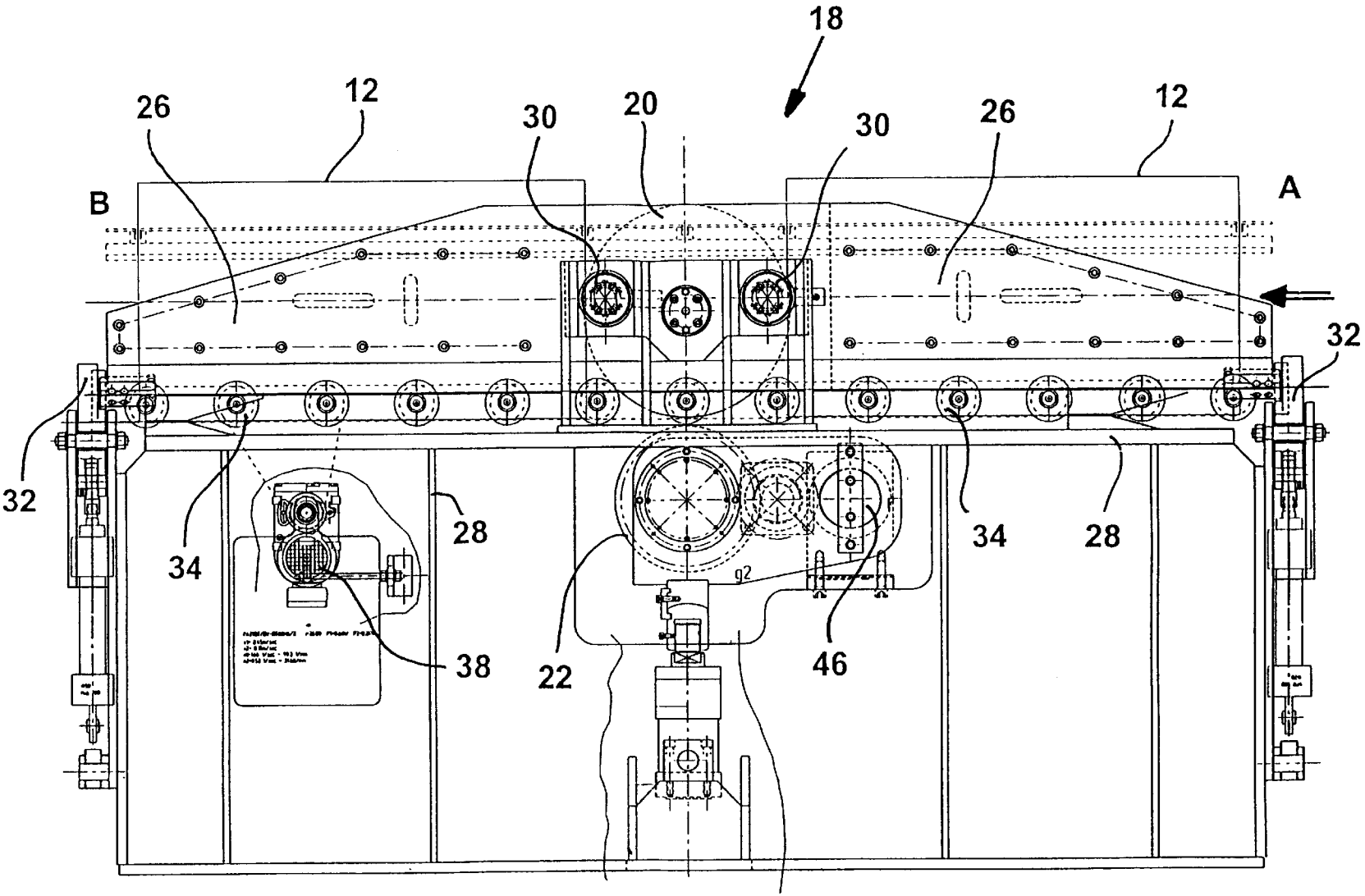
FIG. 2 is a side view of one embodiment of a continuous rolling machine incorporated in the arrangement of FIG. 1.
Figure 4:
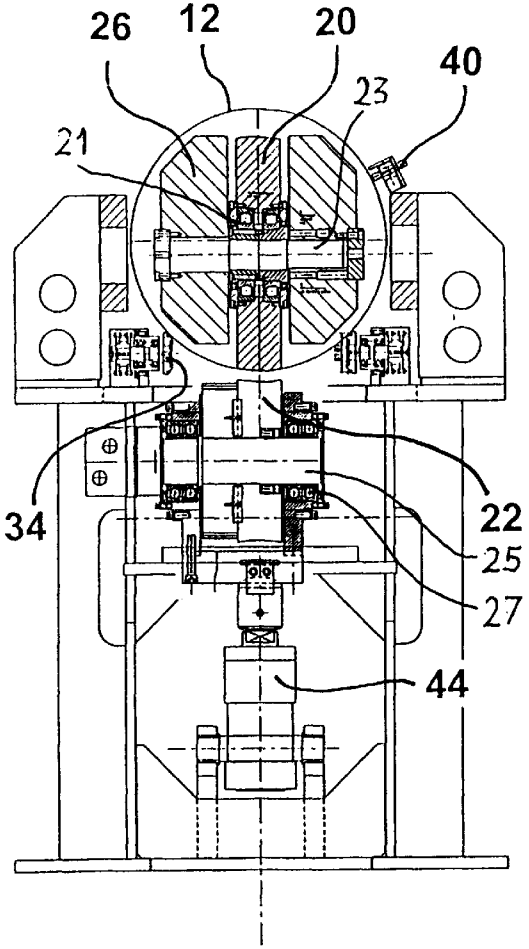
FIG. 4 is a cross section of a central area of the rolling machine of FIG. 2.

The rolling machine 18 for rolling and smoothing the longitudinal seam is configured as high-performance continuous rolling machine and has an entry or loading zone A for incoming bodies 12 and an exit or unloading zone B for discharge of finished bodies 12, as shown in particular in FIG. 2. The rolling machine 18 includes a lower drum stand 28 and an upper carrier frame 26. The upper carrier frame 26 is, supported in "alternating floating" manner either by a central first locking device or by an outer second locking device. During incoming of a not yet rolled body 12 onto the forward part of the upper carrier frame 26 at the entry zone A, a simultaneous discharge of a finished body 12 from the rear part of the upper carrier frame 26 at exit zone B is implemented, whereby the upper carrier frame 26 is temporarily securely connected to the lower drum stand 28 via the central locking device in the form of laterally engaging locking pins 30. As soon as the loading/unloading process is over, so that only a single body 12 is positioned in the loading zone A, the upper carrier frame 26 is temporarily securely connected to the lower drum stand 28 at the outside by the second locking device in the form of inwardly swingable locking claws 32. At the same time, the central locking pins 30 are so controlled as to return in proximity of the upper and lower rolling drums 20, 22 to their disengaged position. Thus, the upper carrier frame 26 is cleared over its entire length for the subsequent rolling process, whereby the body 12 is conducted from the loading station A via the interacting pair of rolling drums 20, 22 to the exit zone B, with the longitudinal welding seam being rolled flat hereby. The lower rolling drum 22, which is operated by a rotary drive 46, is hereby moved upwards against the longitudinal weld of the body 12 and pressed against the upper rolling drum 20 which is positioned on the inside of the body 12, as shown in FIG. 4.

The continuous rolling machine 18 is synchronized to the automatic welding machine to run at a 4.5 seconds clock cycle. This means, a body 12 is introduced within 4.5 seconds on the (right) entry zone A by the transfer conveyor 16 into the rolling apparatus 18 and a finished body 12 that underwent a rolling process exits the rolling machine 18 at the exit zone B. After changing the locked engagement between the upper carrier frame 26 and the lower drum stand 28 from the central locking device (locking pins 30) to the outer locking device (locking claws 32), the currently loaded body 12 is moved by the central pair of rolling drums 20, 22 to the opposite side, i.e. exit zone B of the rolling machine 18, and hereby rolled. The following process steps are carried out in sequence:

The lower rolling drum 22 is moved upwards in rolling position by a hydraulic unit 44 by a small portion (e.g. 50 mm) to the operative position and is driven by a motor 46. The body 12 being handled is conducted to the upper and lower rolling drums 20, 22 and advanced through the gap between the rolling drums 20, 22, thereby carrying out the actual smoothing or rolling process. As soon as the smoothed body 12 has passed the rolling drums 20, 22 and reached the exit zone B, the locking pins 30 of the central locking device of the upper carrier frame 26 is activated again, and the locking claws 32 of the external locking device swing out to disengage, so as to allow entry of a new body 12 while the finished body 12 can be discharged by means of a simple roller-type conveyor mounted on top of the lower drum stand 28 and including several rubberized rollers 34 driven by a drive motor 38 via a chain 36.

Figure 3:
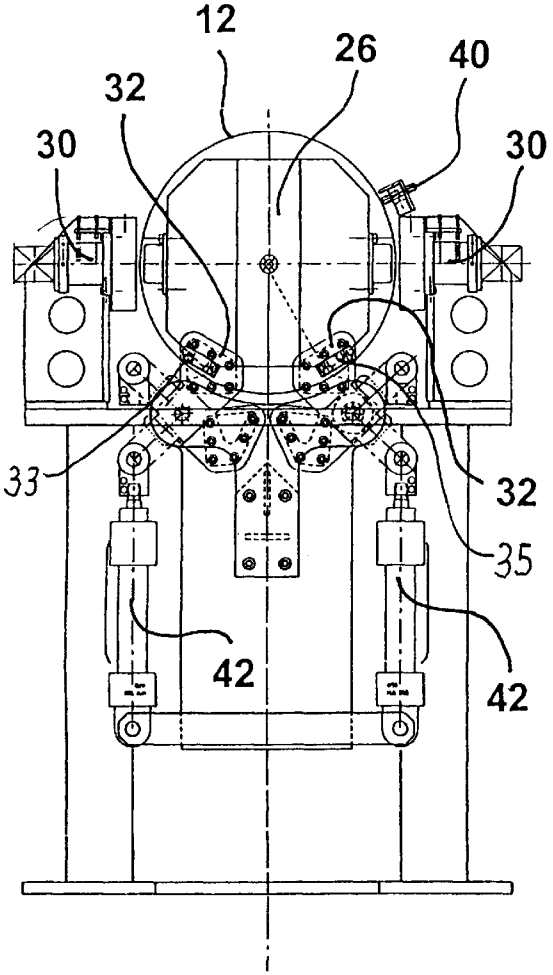
FIG. 3 is a front view of the rolling machine.

Turning now to FIG. 3, there is shown a front view of the upper carrier frame 26, and depicting the locking claws 32 which are swiveled inwardly by hydraulic cylinders 42 mounted to the lower drum stand 28, thereby temporarily supporting and interconnecting the upper carrier frame 26 with the lower drum stand 28. The locking claws 32 are formed with a slot 33 for engagement of pins 35 jutting out from the carrier frame 26

FIG. 4 shows a central cross section through the rolling machine 18 in the area of the rolling drums 20, 22. The lower rolling drum 22 is hereby not yet moved upwards by the hydraulic unit 44 and thus not yet in operative position. The locking pins 30 of the central locking device are hereby also not yet in operative position so that the upper carrier frame 26 is supported and secured at this point in time by the locking claws 32 (not visible here) of the outer locking device. The upper rolling drum 20 is mounted via bearings 21 on a shaft 23 which is journaled on opposite ends in the carrier frame 26, whereas the lower rolling drum 22 is mounted on a shaft 25 which is supported via bearings 27 on opposite ends by the lower drum stand 28. The upper and lower rolling drums 20, 22 have a comparably slender configuration, with the lower rolling drum 22 configured with a concave outer rolling surface, and the upper rolling drum 20 configured with a complementary convex outer rolling surface.

Figure 5:
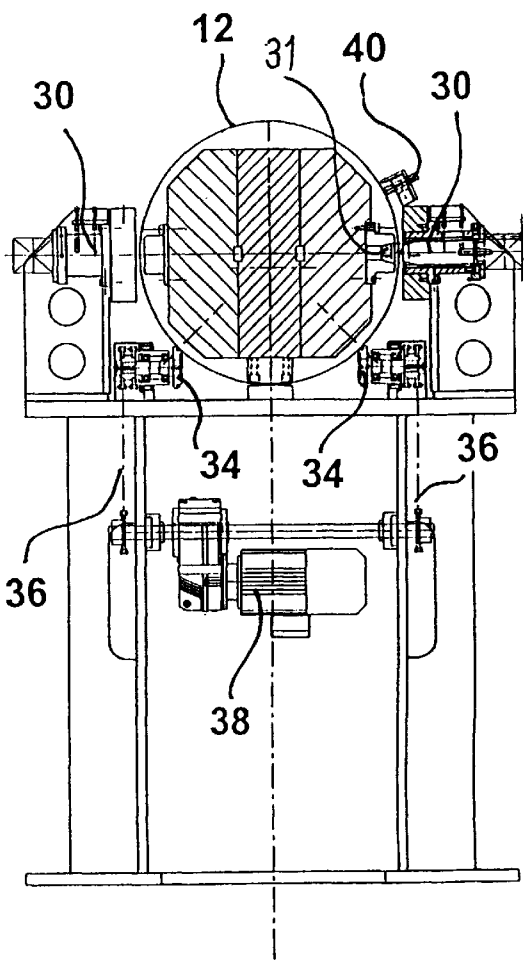
FIG. 5 is a cross section of the rolling machine in an area of the drive for conveyor rollers.

FIG. 5 shows essentially the roller-type conveyor, including the rollers 34, chain 36 and drive motor 38, for implementing a linear transport of the bodies 12 inside the rolling machine 18. The advancing bodies 12 are additionally supported and guided by support rollers 40 acting from outside. Also shown here are the lateral locking pins 30 of the central locking device, which are activated by small hydraulic cylinders. The locking pins 30, preferably four locking pins 30, with two locking pins 30 on each side of the carrier frame 26, cooperate with complementary receptacles 31 of the carrier frame 26. Thus, during the period in which a new body 12 is positioned at the entry zone A and a finished body 12 is positioned at the exit zone B, the locking pins 30 are moved inwardly into the receptacles 31 for temporarily interconnecting the carrier frame 26 with the drum stand 28.

The illustrated, continuous smoothing arrangement according to the invention for drum bodies is capable of rolling or smoothing at a clock time of about 4.5 seconds up to 800 bodies per hour. The body length that can be processed for a 220 liters steel drum amounts to approximately 900 to 1100 mm at a body diameter of about 575 mm. Bodies of different sheet metal thickness of e.g. 0.8 mm, 1.0 mm, 1.2 mm or 1.5 mm can be processed.

The overlap area along the longitudinal welding seam has a width of about 3 mm. Thus, the body 12 has about twice the wall strength before the rolling process. After the rolling process, the body 12 is rolled flat or down in the overlap area to almost single, i.e. normal) wall thickness. The bodies 12 could also be designed with slight taper for e.g. stackable lidded drums, e.g. wide-necked packing drums. In this case, it is only necessary to correspondingly adjust the roller guide for the longitudinal transport of such conical bodies.

While the invention has been illustrated and described as embodied in a rolling machine, it is not intended to be limited to the details shown since various modifications and structural changes may be made without departing in any way from the spirit of the present invention.

What is claimed as new and desired to be protected by Letters Patent is set forth in the appended claims:

1. A rolling machine for processing a metal container which has a longitudinal seam and is made from a flat metal plate to form a cylindrical body having adjacent or overlapping butt edges securely joined to one another by folding or welding, whereupon a disk-shaped lower bottom and, optionally, a respective upper bottom, is welded or folded to the cylindrical body to form a closed container, or an open-topped container, respectively, with the adjacent or overlapping butt edges of the cylindrical body being subject to a rolling process over an entire length of the cylindrical body in the area of the longitudinal folding seam or longitudinal welding seam after the folding process or welding process and prior to the attachment of the at least lower bottom, said rolling machine being configured as a continuous rolling machine and comprising an upper carrier frame; an upper rolling drum rotatably supported in the upper carrier frame; a lower drum stand; and a driven lower rolling drum rotatably mounted in the lower drum stand; and a central first locking device and a second locking device positioned at opposite axial ends of the rolling machine, wherein the upper carrier frame is provided for acting on an inside surface of the body and is supported in a floating manner by alternating an engagement of the first and second locking devices.

2. The rolling machine of claim 1, wherein the upper and lower rolling drums have a comparably slender configuration, with the lower rolling drum configured with a concave outer rolling surface, and the upper rolling drum configured with a complementary convex outer rolling surface.

3. The rolling machine of claim 1, and further comprising a hydraulic unit positioned in the lower drum stand and operatively connected to the lower rolling drum for displacing the lower rolling drum in a vertical direction so as to serve as pressure applying device, and a rotary drive operatively connected to the lower rolling drum.

4. The rolling machine of claim 1, wherein the upper rolling drum is positioned at a central location in the upper carrier frame.

5. The rolling machine of claim 1, wherein the upper carrier frame has an entrance upstream of the upper rolling drum for loading a new body, and an exit downstream of the upper rolling drum for simultaneous discharge of a finished body.

6. The rolling machine of claim 1, wherein the interacting upper and lower rolling drums are arranged at the lower drum stand and at the upper carrier frame at a central location of the continuous rolling machine, with the upper carrier frame having a length sufficient to receive at least one body upstream and downstream of the upper rolling drum.

7. The rolling machine of claim 1, wherein the first locking device has a total of four locking pins and a hydraulic cylinder for operating the locking pins, said locking pins being arranged such that two of said locking pins are arranged on one side of a support of the upper rolling drum and two of said locking pins are arranged on another side of the support of the upper rolling drum.

8. A rolling machine for processing a metal container which has a longitudinal seam and is made from a flat metal plate to form a cylindrical body having adjacent or overlapping butt edges securely joined to one another by folding or welding, whereupon a disk-shaped lower bottom and, optionally, a respective upper bottom, is welded or folded to the cylindrical body to form a closed container, or an open-topped container, respectively, with the adjacent or overlapping butt edges of the cylindrical body being subject to a rolling process over an entire length of the cylindrical body in the area of the longitudinal folding seam or longitudinal welding seam after the folding process or welding process and prior to the attachment of the at least lower bottom, said rolling machine being configured as a continuous rolling machine and comprising an upper carrier frame; an upper rolling drum rotatably supported in the upper carrier frame; a lower drum stand; and a driven lower rolling drum rotatably mounted in the lower drum stand; and a central first locking device and a second locking device positioned at opposite axial ends of the rolling machine, wherein the upper carrier frame is provided for acting on an inside surface of the body and is supported in a floating manner by alternating an engagement of the first and second locking devices, wherein the second locking device has in-and-out swingable locking claws for locked engagement of the upper carrier frame part during the rolling process on both outer sides with the lower drum stand.

9. The rolling machine of claim 8, wherein the second locking device includes a hydraulic drive for operating the locking claws to establish an external locking of the upper carrier frame with the lower drum stand.

10. The rolling machine of claim 8, wherein the upper and lower rolling drums have a comparably slender configuration, with the lower rolling drum configured with a concave outer rolling surface, and the upper rolling drum configured with a complementary convex outer rolling surface.

11. The rolling machine of claim 8, and further comprising a hydraulic unit positioned in the lower drum stand and operatively connected to the lower rolling drum for displacing the lower rolling drum in a vertical direction so as to serve as pressure applying device, and a rotary drive operatively connected to the lower rolling drum.

12. The rolling machine of claim 8, wherein the upper rolling drum is positioned at a central location in the upper carrier frame.

13. The rolling machine of claim 8, wherein the upper carrier frame has an entrance upstream of the upper rolling drum for loading a new body, and an exit downstream of the upper rolling drum for simultaneous discharge of a finished body.

14. The rolling machine of claim 8, wherein the interacting upper and lower rolling drums are arranged at the lower drum stand and at the upper carrier frame at a central location of the continuous rolling machine, with the upper carrier frame having a length sufficient to receive at least one body upstream and downstream of the upper rolling drum.

15. The rolling machine of claim 8, wherein the first locking device has a total of four locking pins and a hydraulic cylinder for operating the locking pins, said locking pins being arranged such that two of said locking pins are arranged on one side of a support of the upper rolling drum and two of said locking pins are arranged on another side of the support of the upper rolling drum.

16. A rolling machine for processing a metal container which has a longitudinal seam and is made from a flat metal plate to form a cylindrical body having adjacent or overlapping butt edges securely joined to one another by folding or welding, whereupon a disk-shaped lower bottom and, optionally, a respective upper bottom, is welded or folded to the cylindrical body to form a closed container, or an open-topped container, respectively, with the adjacent or overlapping butt edges of the cylindrical body being subject to a rolling process over an entire length of the cylindrical body in the area of the longitudinal folding seam or longitudinal welding seam after the folding process or welding process and prior to the attachment of the at least lower bottom, said rolling machine being configured as a continuous rolling machine and comprising an upper carrier frame; an upper rolling drum rotatably supported in the upper carrier frame; a lower drum stand; and a driven lower rolling drum rotatably mounted in the lower drum stand; and a central first locking device and a second locking device positioned at opposite axial ends of the rolling machine, wherein the upper carrier frame is provided for acting on an inside surface of the body and is supported in a floating manner by alternating an engagement of the first and second locking devices, wherein the first locking device includes a locking pin, said carrier frame being secured in locked engagement with the lower drum stand during loading of a new unrolled body and during discharge of a rolled finished body.

17. A rolling machine for smoothening a longitudinal seam between overlapping folded or welded edges of a body, said rolling machine being configured as a continuous rolling machine and comprising:

a framework including an upper carrier frame and a lower drum stand;

an upper drum rotatably supported in the carrier frame;

a lower drum rotatably mounted in the drum stand and interacting with the upper drum for rolling a body; and first and second locking devices for interconnecting the carrier frame to the drum stand in alternating manner depending on a position of the body in the framework, such that the first locking device is positioned at a central location of the framework, and the second locking device is positioned at opposite axial ends of the framework.

18. The rolling machine of claim 17, wherein the lower rolling drum has a concave rolling surface, and the upper rolling drum has a complementary convex rolling surface.

19. The rolling machine of claim 17, and further comprising a hydraulic unit mounted in the lower drum stand for displacing the lower rolling drum in a direction of the upper rolling drum, and a rotary drive for rotating the lower rolling drum.

20. The rolling machine of claim 17, wherein the second locking device has in-and-out swingable locking claws for locked engagement of the upper carrier frame part during the rolling process.

21. The rolling machine of claim 17, wherein the first locking device includes a locking pin, said carrier frame being secured in locked engagement with the lower drum stand during loading of the new body and during discharge of a rolled finished body.

22. The rolling machine of claim 17, wherein the upper carrier frame has a length sufficient to receive at least one body upstream and downstream of the upper rolling drum.

23. A process of operating a rolling machine for rolling a body, comprising the steps of:

connecting an upper carrier frame to a lower drum stand by a first central locking device when a new body enters the rolling machine; and connecting the upper carrier frame to the lower drum stand from opposite outside end-positions by a pair of second central locking devices when said body is rolled between a pair of superimposed drums of the rolling machine and the first locking device is disengaged.

* * * * *